US008881898B2

(12) United States Patent
DeForest

(10) Patent No.: US 8,881,898 B2
(45) Date of Patent: Nov. 11, 2014

(54) WHEEL STORAGE AND TRANSPORT FRAME

(75) Inventor: Michael DeForest, Athens, GA (US)

(73) Assignee: Mobile Shelter Systems, Inc., Helotes, TX (US)

( * ) Notice: Subject to any disclaimer, the term of this patent is extended or adjusted under 35 U.S.C. 154(b) by 424 days.

(21) Appl. No.: 12/872,760

(22) Filed: Aug. 31, 2010

(65) Prior Publication Data

US 2011/0210023 A1 Sep. 1, 2011

Related U.S. Application Data

(60) Provisional application No. 61/238,836, filed on Sep. 1, 2009.

(51) Int. Cl.
*B65D 85/06* (2006.01)
*B65D 19/08* (2006.01)

(52) U.S. Cl.
CPC ..... *B65D 85/06* (2013.01); *B65D 19/08* (2013.01); *B65D 2519/00805* (2013.01); *B65D 2519/00815* (2013.01)
USPC ..... 206/304.2; 26/304; 211/23

(58) Field of Classification Search
CPC ..... B65D 85/06; B65D 19/08; B65D 2519/00805; B65D 2519/00815
USPC ..... 206/304.2, 340; 211/175, 208, 189, 211/194, 195, 85.8, 183, 23, 24, 20, 180; 108/55.1, 56.1
See application file for complete search history.

(56) References Cited

U.S. PATENT DOCUMENTS

| | | | | |
|---|---|---|---|---|
| 2,928,540 | A | 3/1960 | Cunningham | |
| 3,322,286 | A * | 5/1967 | Sylvester | 211/24 |
| 3,407,926 | A | 10/1968 | Rosser | |
| 3,547,258 | A | 12/1970 | Black | |
| 3,812,974 | A | 5/1974 | Sylvester | |
| 3,850,295 | A | 11/1974 | Black | |
| 3,915,303 | A | 10/1975 | Tatham | |
| 3,987,915 | A | 10/1976 | Conner | |
| 4,290,370 | A | 9/1981 | Gallagher | |
| 4,295,431 | A * | 10/1981 | Stavlo | 108/55.1 |
| 4,714,169 | A * | 12/1987 | Keenan et al. | 220/8 |
| 5,378,106 | A * | 1/1995 | Risley et al. | 414/608 |

(Continued)

*Primary Examiner* — Antony Stashick
*Assistant Examiner* — Ernesto Grano
(74) *Attorney, Agent, or Firm* — Michael A. Blake

(57) ABSTRACT

A wheel storage and transport frame comprising: a floor; a first corner pillar fixedly attached to the floor; a second corner pillar fixedly attached to the floor; a third corner pillar fixedly attached to the floor; a fourth corner pillar fixedly attached to the floor; a first end wall fixedly attached to the floor and the first and second corner pillars; a rear wall fixedly attached the floor and the second and third corner pillars; a second end wall fixedly attached to the floor and third and fourth corner pillars; a rotatable front panel rotatably attached to the floor via at least one hinged element, and adjacent to the first and fourth corner pillars, the bottom of the rotatable front panel remaining generally parallel to the floor, and the top of the rotatable front panel also remaining generally parallel to the floor and also moveable in generally a circular path. a first rear attachment means removeably attachable to the wheel storage and transport frame; a first strap attached to the first rear attachment means; a first front attachment means attached to the first strap, and removeably attachable to the rotatable front panel; and a first tensioning means in communication with the first strap, and attached to the wheel storage and transport frame.

8 Claims, 11 Drawing Sheets

(56) References Cited

U.S. PATENT DOCUMENTS

| | | | | | |
|---|---|---|---|---|---|
| 5,626,241 | A * | 5/1997 | Holden | 211/23 |
| 5,671,850 | A * | 9/1997 | Basala | 211/23 |
| 6,044,990 | A | 4/2000 | Palmeri | |
| 6,164,476 | A | 12/2000 | Rene | |
| 6,273,670 | B1 | 8/2001 | Henson | |
| 6,298,999 | B1 | 10/2001 | Bellman | |
| 6,422,405 | B1 | 7/2002 | Haenszel | |
| 6,637,077 | B2 * | 10/2003 | Doty | 24/302 |
| 2006/0156694 | A1 | 7/2006 | Aubin | |
| 2006/0214446 | A1 * | 9/2006 | Johns | 296/24.32 |
| 2009/0148260 | A1 | 6/2009 | Leimbach | |

* cited by examiner

WHEEL STORAGE AND TRANSPORT FRAME

CROSS-REFERENCES

The present application claims the benefit of provisional patent application No. 61/238,836 filed on Sep. 1, 2009 by Michael Deforest, the entire contents of which are fully incorporated by reference herein.

TECHNICAL FIELD

The invention relates to wheel storage and transport frames, and, more particularly, to wheel storage and transport frames for storing and transporting cargo such as, but not limited to vehicle wheels.

BACKGROUND

There is a need to package large quantities of different sized vehicle wheels for transport. The primary means of transportation are shipping containers and as secondary loads in vehicles, such as pick up trucks, humvees, tractor trailers, etc. Therefore the wheels need to be packaged on an apparatus that is moveable and transportable because packaging of the wheels may occur prior to loading containers or trucks. The wheel weights may range from about 50 lbs to about 1000 lbs or more, thus the apparatus needs to be strong enough to support heavy loads. Additionally, there is a need to maximize the available space inside of the shipping container or truck (or other vehicle carrying a secondary load) by volume. A new regulation for Government Agencies who ship wheels is that the wheels should be stored vertically to extend the life of the wheels while in storage. It has been determined that flat packing of wheels on top of each other cause the wheels to deteriorate in storage.

Currently, the commercial practice of packing wheels for shipping in trucks is to have them individually loaded and off loaded by people. This is time intensive, and risks injury to those loading and unloading the wheels. For other transport, wheels are packed flat on wooden pallets and then secured to the pallet for transport. Using pallets often leads to flat stacking of wheels in violation of government regulations.

Thus there is a need for a wheel storage and transport device that overcomes the above listed and other disadvantages.

SUMMARY OF THE INVENTION

The disclosed invention relates to a wheel storage and transport frame comprising: a floor; a first corner pillar fixedly attached to the floor; a second corner pillar fixedly attached to the floor; a third corner pillar fixedly attached to the floor; a fourth corner pillar fixedly attached to the floor; a first end wall fixedly attached to the floor and the first and second corner pillars; a rear wall fixedly attached the floor and the second and third corner pillars; a second end wall fixedly attached to the floor and third and fourth corner pillars; a rotatable front panel rotatably attached to the floor via at least one hinged element, and adjacent to the first and fourth corner pillars, the bottom of the rotatable front panel remaining generally parallel to the floor, and the top of the rotatable front panel also remaining generally parallel to the floor and also moveable in generally a circular path. a first rear attachment means removeably attachable to the wheel storage and transport frame; a first strap attached to the first rear attachment means; a first front attachment means attached to the first strap, and removeably attachable to the rotatable front panel; and a first tensioning means in communication with the first strap, and attached to the wheel storage and transport frame.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
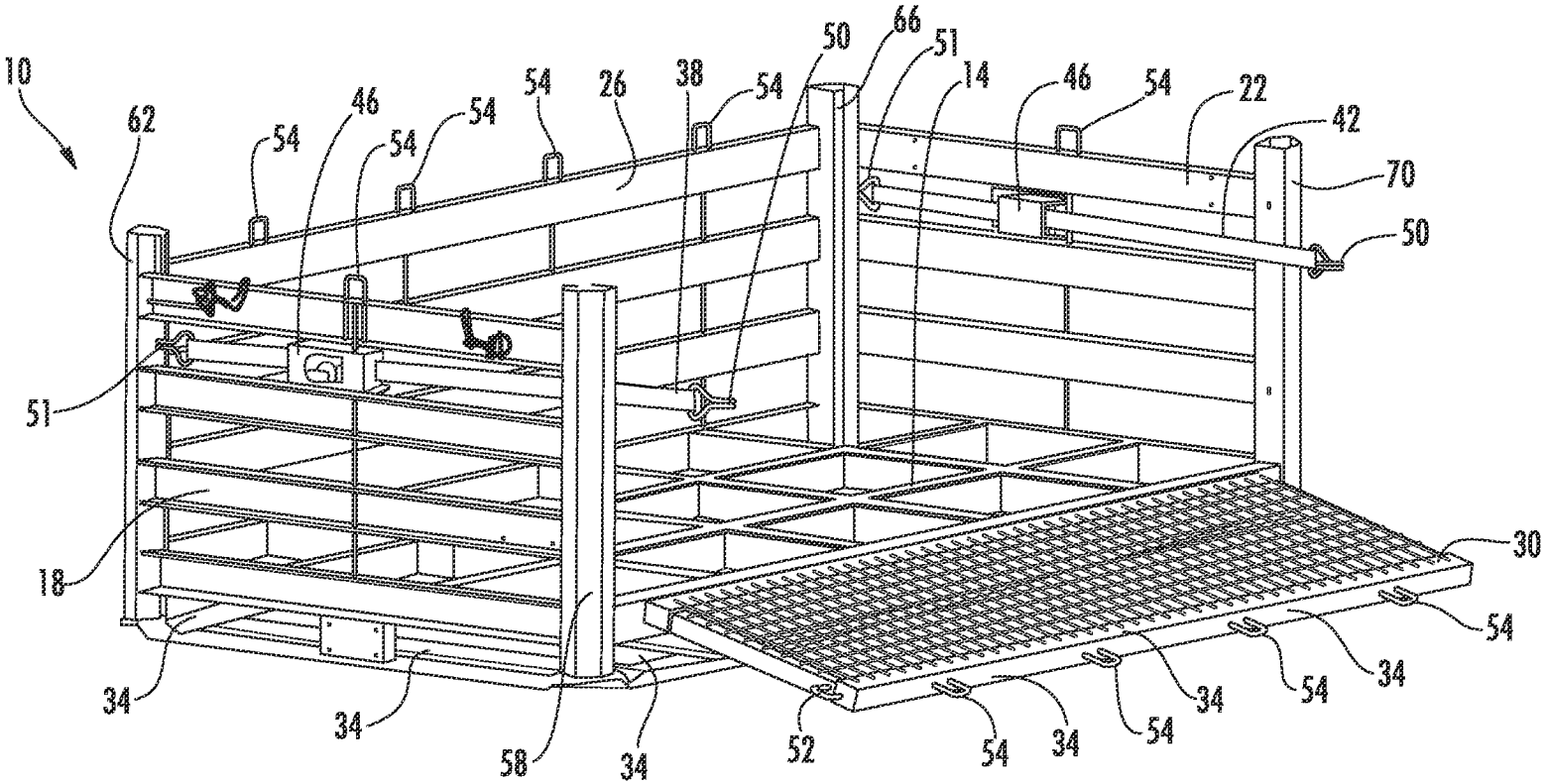
FIG. 1 is a front perspective view of an empty tire storage and transport frame.

FIG. 1 shows a front perspective view of the wheel storage and transport frame 10. The frame 10 comprises a floor 14, a first end wall 18, a second end wall 22, a rear wall 26, and a rotatable front panel 30. A first corner pillar 58 is attached to the first end wall and is generally adjacent to the panel 30. A second corner pillar 62 is attached to the first end wall 18 and the rear wall 26. A third corner pillar 66 is attached to the rear wall 26 and second end wall 22. A fourth corner pillar 70 is attached to the second end wall 22 and is generally adjacent to the panel 30. The frame 10 may have a plurality of fork lift pockets 34 located generally adjacent to the floor 14. The rotatable front panel 30 is hinged with respect to the frame 10, and rotates from a ramp position shown in FIG. 1, to many closed positions depending on the size and configuration of the wheels being stored and/or transported in the frame 10. The rotatable front panel 30 is generally fixed in any of the closed positions by adjusting a first strap 38 and second strap 42, and attaching the strap to the panel 30. The straps 38, 42 are generally fixed to the frame 10, and each will have a tensioning means 46, such as, but not limited to a tensioning buckle or ratchet strap. The straps 38, 42, will have an attachment means 50 located generally at one end of each of the straps, for attaching to the panel 30. The attachments means 50 may be hooks, cotter pins, snap links, or any other suitable attachment means. The attachment means 50 are configured to attach to an attachment means 52 on the panel 30. The attachment means may be metal loops, or square loops. The walls 18, 22, 26 and rotatable front panel 30 may also have attachment means 54, such as, but not limited to, metal loops, or square loops. These attachment means 54 may be used for strap tie downs. The floor 14, a first end wall 18, a second end wall 22, a rear wall 26, and rotatable front panel 30 may all comprise intersecting vertical and horizontal members, which provides numerous tie down points to secure the objects being transported in the frame 10.

Figure 2:
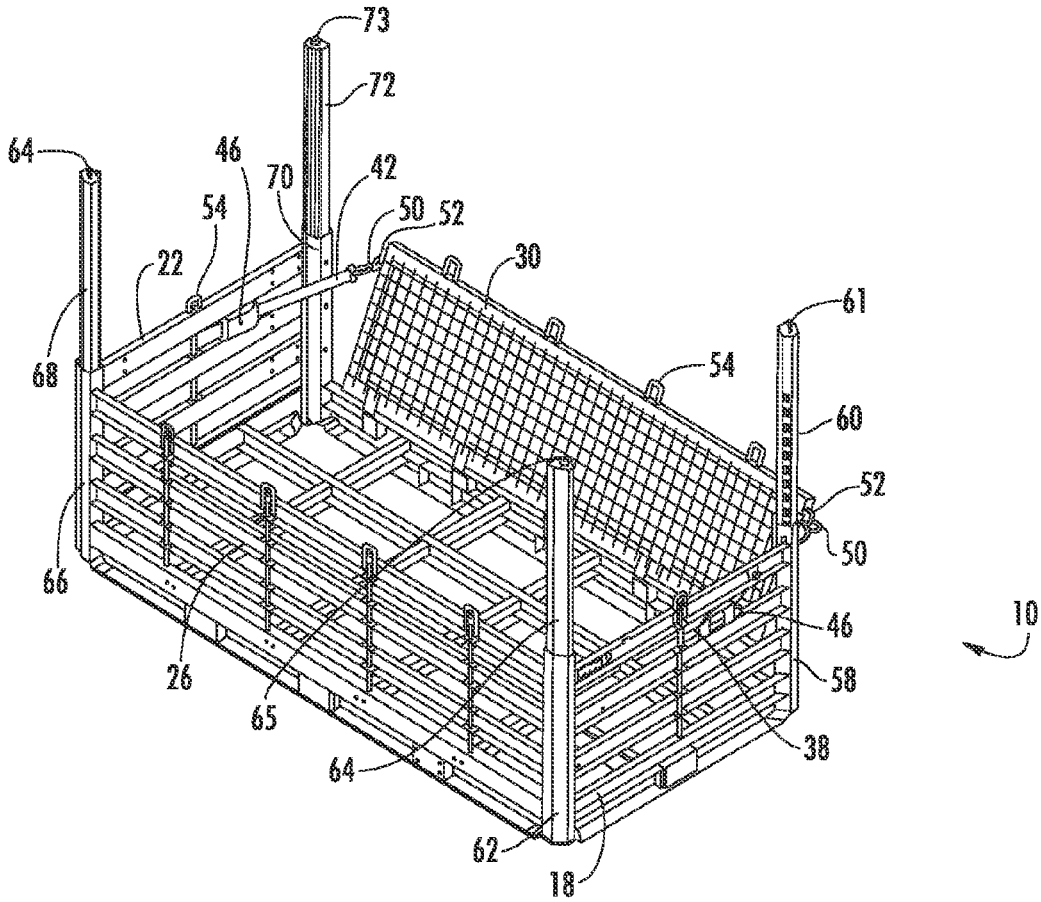
FIG. 2 is a rear perspective view of the tire storage and transport frame with the extendible corner beams installed.

FIG. 2 shows a rear perspective view of the wheel storage and transport frame 10, with the rotatable front panel 30 rotated upwards, but not fully closed. In this view, the straps 38, 42 are shown attached to the panel 30 via the attachment means 50 and 52. The panel 30 is not fully closed, or flush with the first and fourth corner pillars 58, 70, this may be to allow the storage and transport of wheels that are so large or configured in the frame that they would extend somewhat past the first and fourth corner pillars. Also shown in this figure are extendible corner beams. The first corner pillar 58 has a first extendible corner beam 60 extending from it, the second corner pillar 62 has a second extendible corner beam 64 extending from it, the third corner pillar 66 has a third extendible corner beam 68 extending from it, and the fourth corner pillar 70 has a fourth extendible corner beam 72 extending from it. Each of the extendible corner beams are may be adjustably extended from their respective corner pillars. The ability to adjust the heights of the extendible corner beams allows one to configure the frame 10 to store and transport wheels that when loaded into the frame 10 would be taller than the corner pillars 58, 62, 66, 70.

Please note that these frames 10 may be stacked upon one another. A second frame 10 may be stacked on top of a first frame 10 for instance. Please note that each of the extendible beams 60, 64, 68, 72 of the first frame 10 may have a respective stacking stabilizing member 61, 65, 69, and 73, respectively. The first stacking stabilizing member 61, second stacking stabilizing member 65, third stacking stabilizing member 69, and fourth stacking stabilizing member 73, each fits into an orifice in the bottom of a respective corner pillar 58, 62, 66, 70 of the second frame 10. The engagement of each of the stacking stabilizing members 61, 65, 69, 73 of the first frame 10 with a respective orifice of a respective corner pillar 58, 62, 66, 70 of the second frame 10, will prevent the shifting of the stacked frames with respect to each other.

Figure 3:
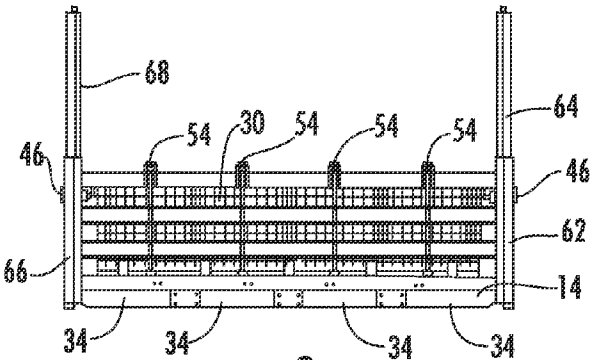
FIG. 3 is a front view of the tire storage and transport frame.

FIG. 3 is a rear view of the disclosed frame 10.

Figure 4:
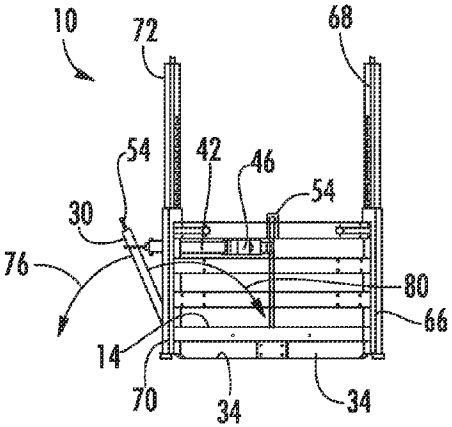
FIG. 4 is a side view of the tire storage and transport frame.

FIG. 4 is a side view of the disclosed frame 10. It should be noted that the rotatable front panel 30 can rotate to the left, as shown by the arrow 76, and be held in place at nearly any position by the straps 38, 42 and tensioning means 46. In addition the panel 30 can rotate all the way to the left such that it abuts the ground, and can be used as a ramp into and out of the frame 10. Similarly, the rotatable front panel 30 can rotate to the right, as shown by the arrow 80, and be held in place at nearly any position by the straps 38, 42 and tensioning means 46. The front panel 30 may further rotate all the way to the right such that the front panel 30 abuts the floor 14. In FIG. 4, the panel 30 is shown rotated slightly to the left (in the direction of the arrow 76) from a generally closed position (i.e. when the panel 30 is generally parallel to the first and fourth corner pillars 58, 70).

Figure 5:
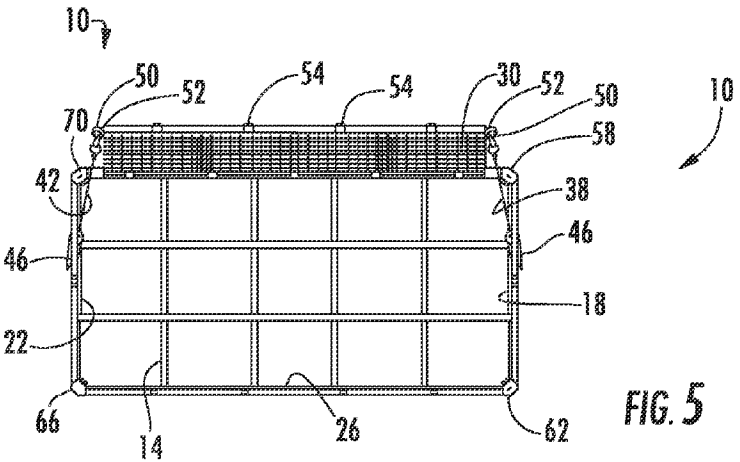
FIG. 5 is a top view of the tire storage and transport frame.

FIG. 5 is a top view of the frame 10.

Figure 6:
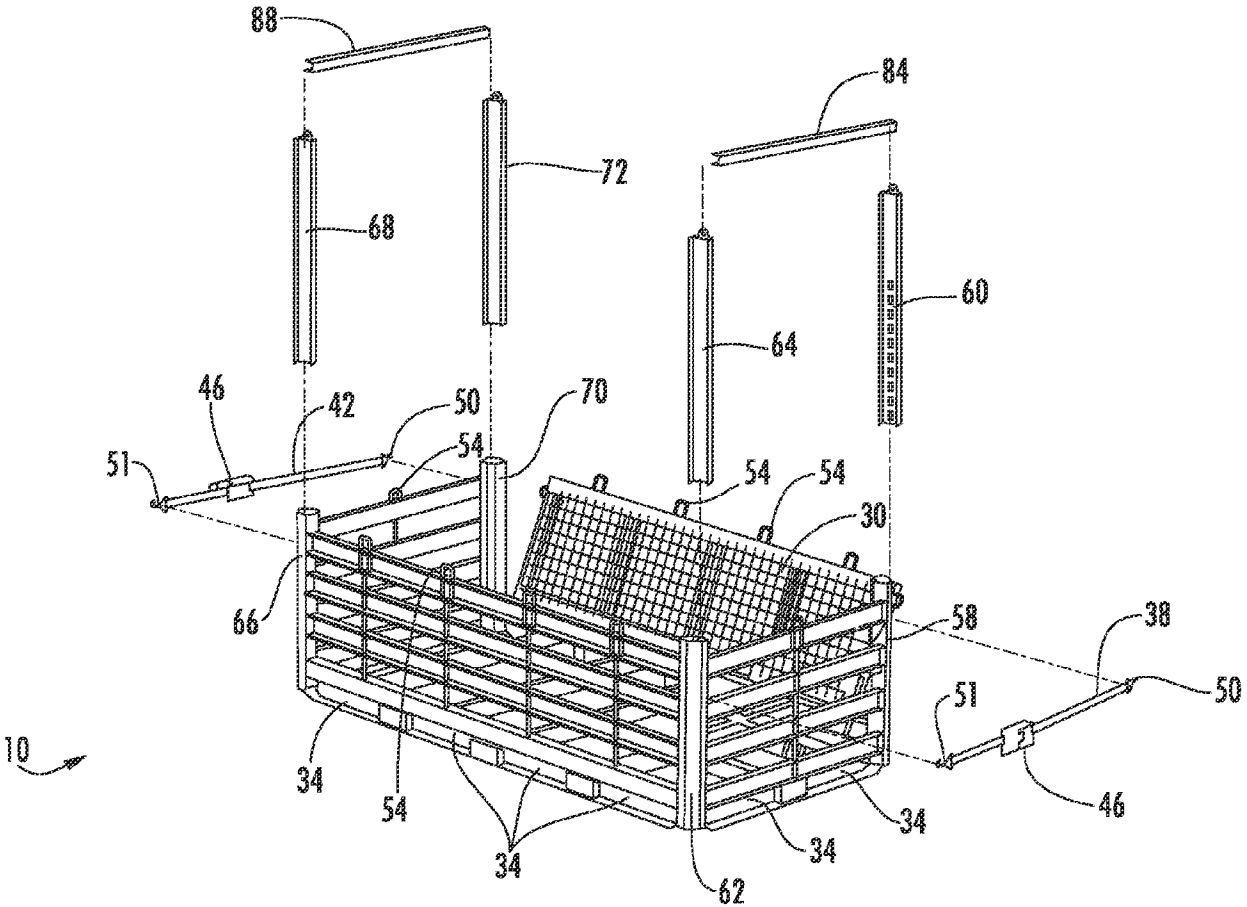
FIG. 6 is an exploded view of the tire storage and transport frame.

FIG. 6 is an exploded view of the frame 10. In this view please note that the straps 38, 42 may have a rear attachments means 51 that allows the straps to hook to the frame 10 on the rear end of the straps 38, 42. The attachment means 51 may be hooks, cotter pins, snap links, or any other suitable attachment means. In addition, the frame 10 may also have a first stabilizer member 84, and second stabilizer member 88. The first stabilizer member 84 attaches to the tops of first extendible corner beam 60 and the second extendible corner beam 64. The second stabilizer member 88 attaches to the tops of third extendible corner beam 68 and the fourth extendible corner beam 72.

Figure 7:
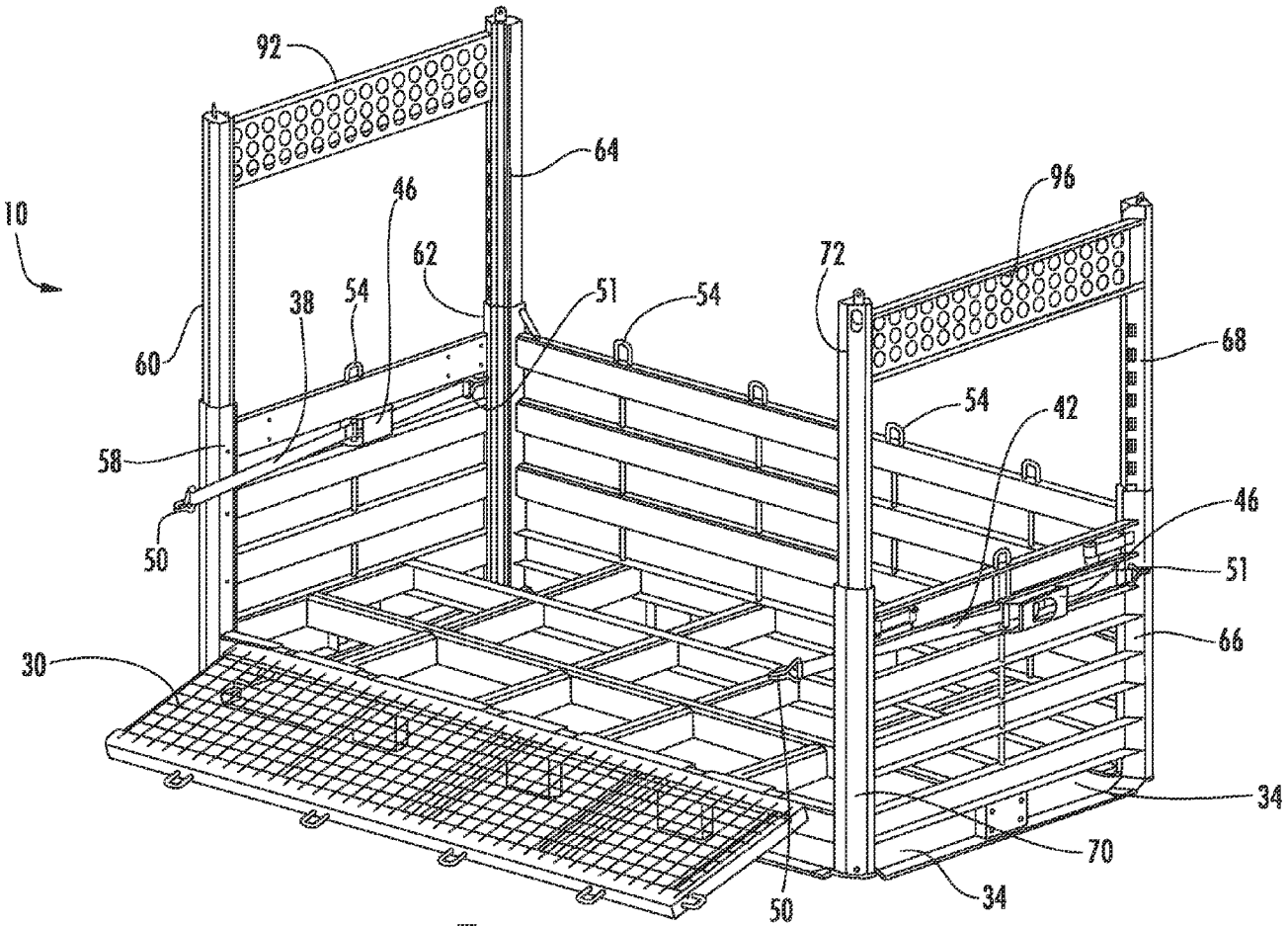
FIG. 7 is a perspective view of the wheel storage and transport frame with the side walls installed.

FIG. 7 shows another embodiment of the wheel storage and transport frame 10. In this embodiment, instead of stabilizer bars 84, 88, the frame has a first side wall 92 and a second side wall 96. The first side wall 92 attaches to the first extendible corner beam 60 and the second extendible corner beam 64. The second side wall 96 attaches to the third extendible corner beam 68 and the fourth extendible corner beam 72. FIG. 7 shows the corner beams 60, 64, 68, 72 generally fully extended and the rotatable front panel 30 rotated out such that it may act as a ramp. The side walls 92, 96 are attachable to the corner beams. The sidewalls 92, 96 may be fastened to the corner beams via snaplinks, locks, cotter pins, etc.

Figure 8:
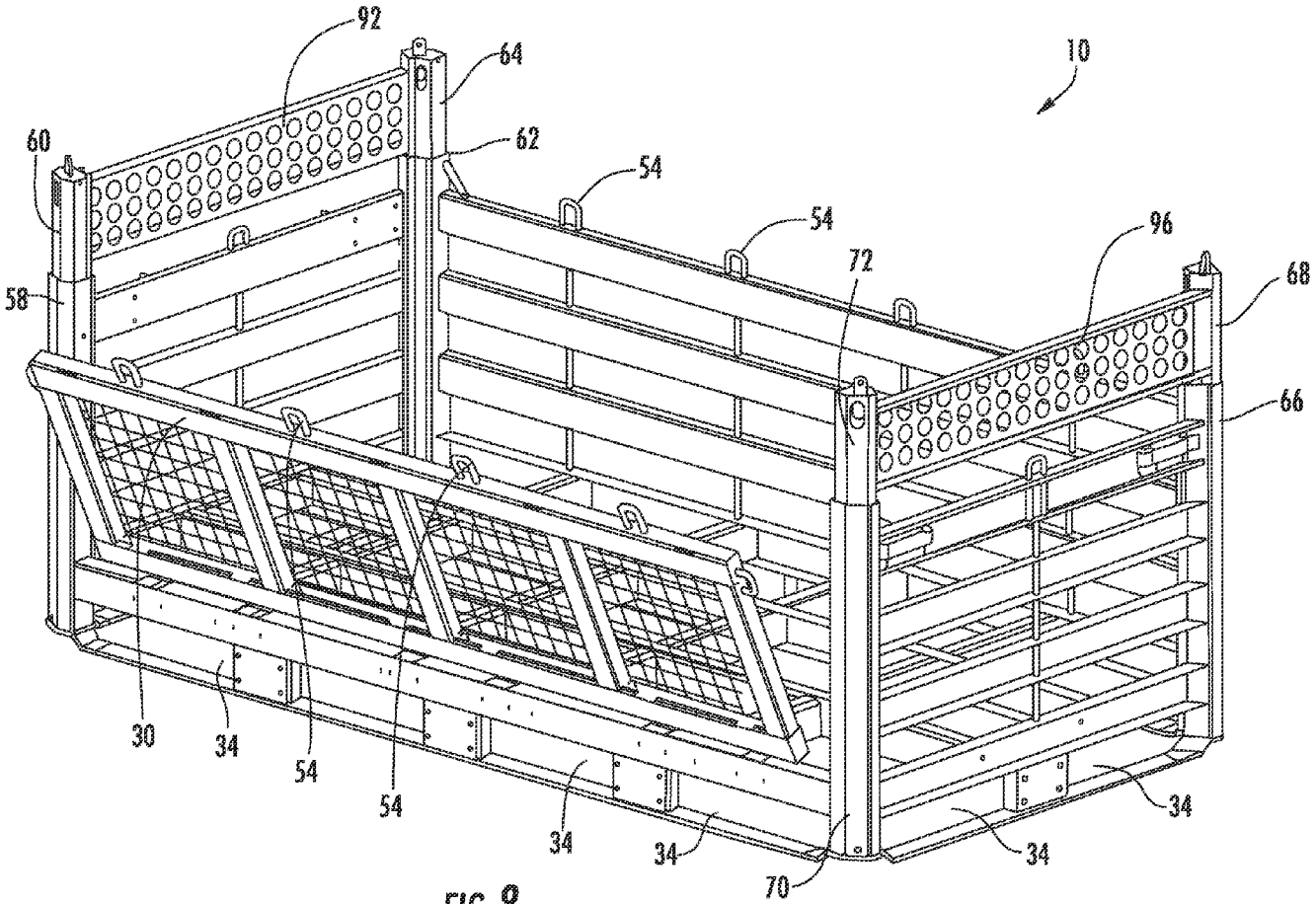
FIG. 8 is a perspective view of the tire storage and transport frame with the side walls installed and the extendible corner beams retracted into the corner pillars.

FIG. 8 shows the embodiment from FIG. 7, but with the corner beams 60, 64, 68, 72 only slightly extended from the pillars. In addition, the panel 30 is no longer in the ramp position, but rather is rotated up towards the interior of the frame 10.

Figure 9:
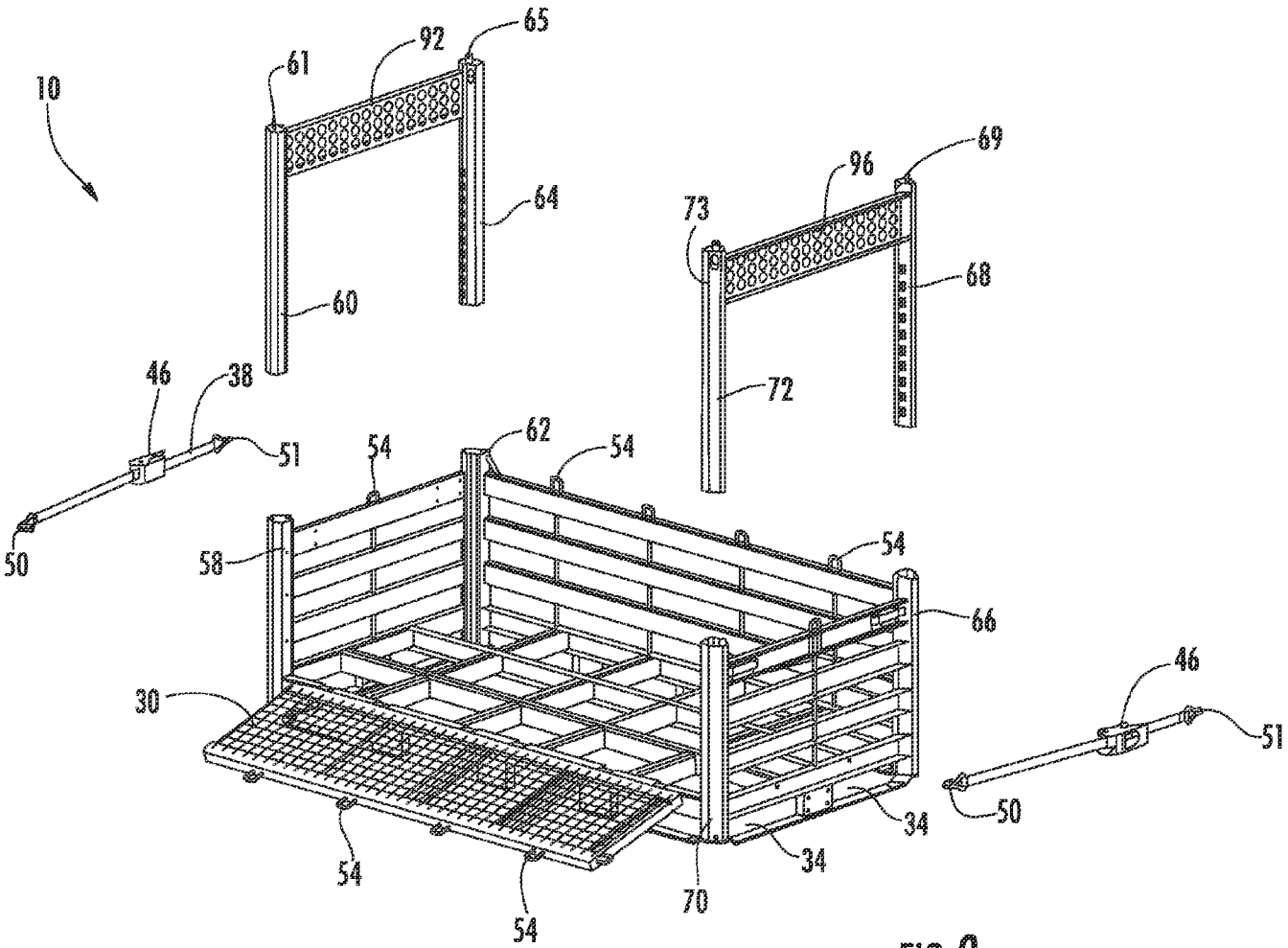
FIG. 9 is an exploded view of the wheel storage and transport frame from FIG. 7.

FIG. 9 shows an exploded view of the embodiment from FIG. 7.

Figure 10:
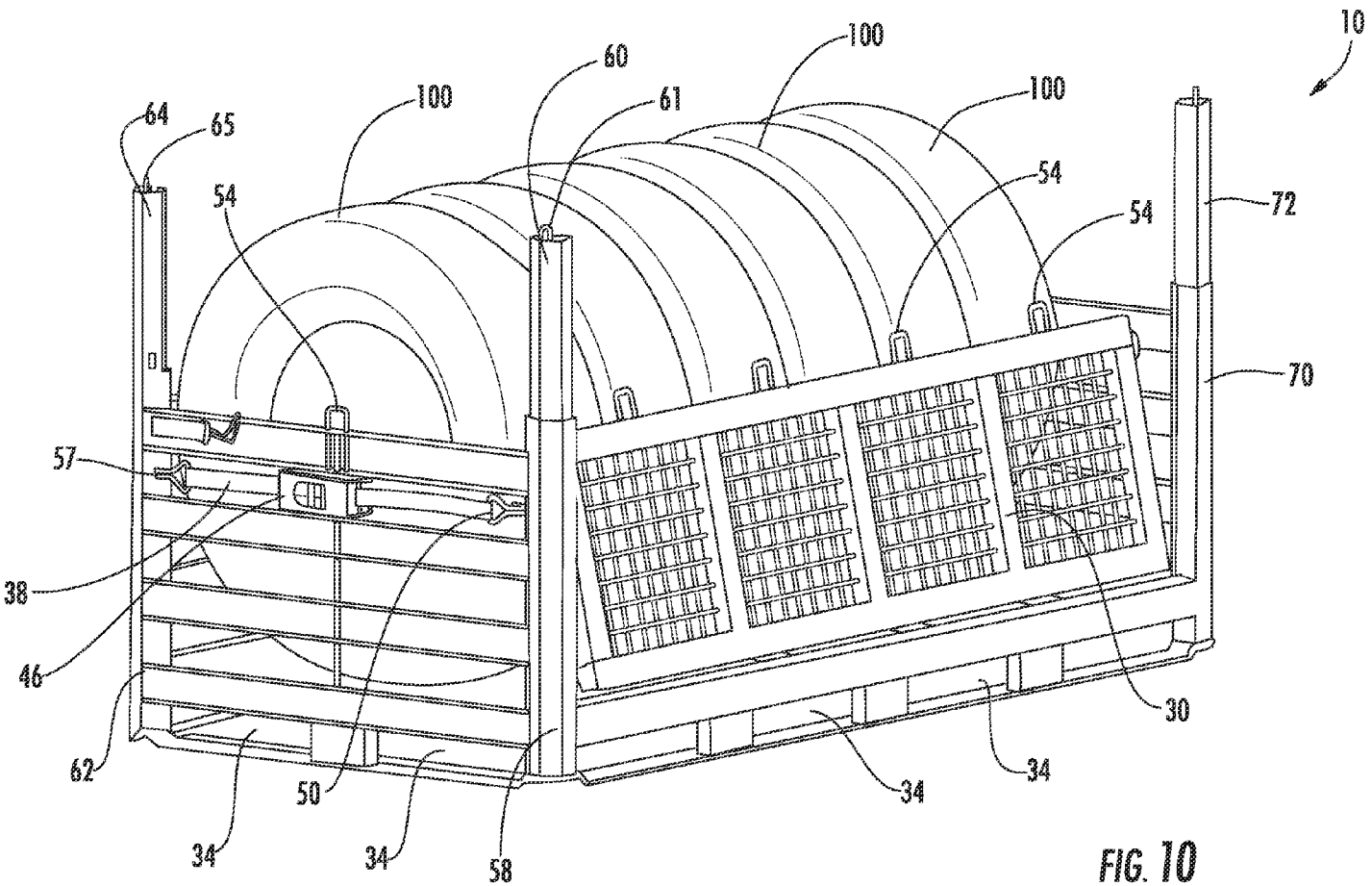
FIG. 10 is a perspective view of the wheel storage and transport frame with wheels loaded.

FIG. 10 shows the frame 10 with medium sized wheels 100 stored in the frame. The wheels are not so big that they extend past the first and fourth corner pillars 58, 70. Thus, the rotatable front panel 30 is rotated so that it abuts against the wheels 100, and is held in place by the straps 38, 42 and the tensioning means 46.

Figure 11:
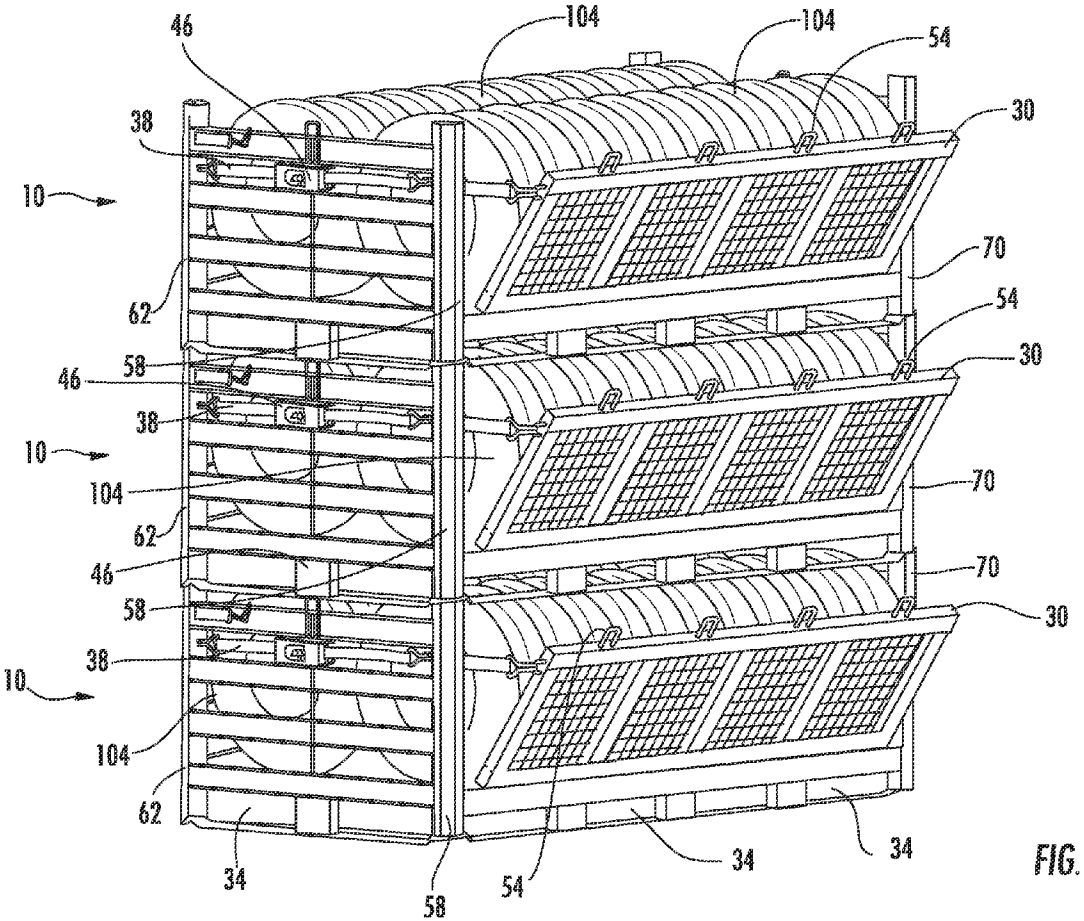
FIG. 11 is a perspective view of three wheel storage and transport frames stacked.

FIG. 11 shows three frames 10 stacked upon one another. In this embodiment, two rows of small wheels 104 are stored in each frame 10. Because the two rows of the wheels causes the wheels 104 to extend past the first and fourth corner pillars 58, 70, the panel 30 is rotated slightly outward, but still abutting the wheels 104, and held in place by the straps 38, 42 and tensioning means 46.

Figure 12:
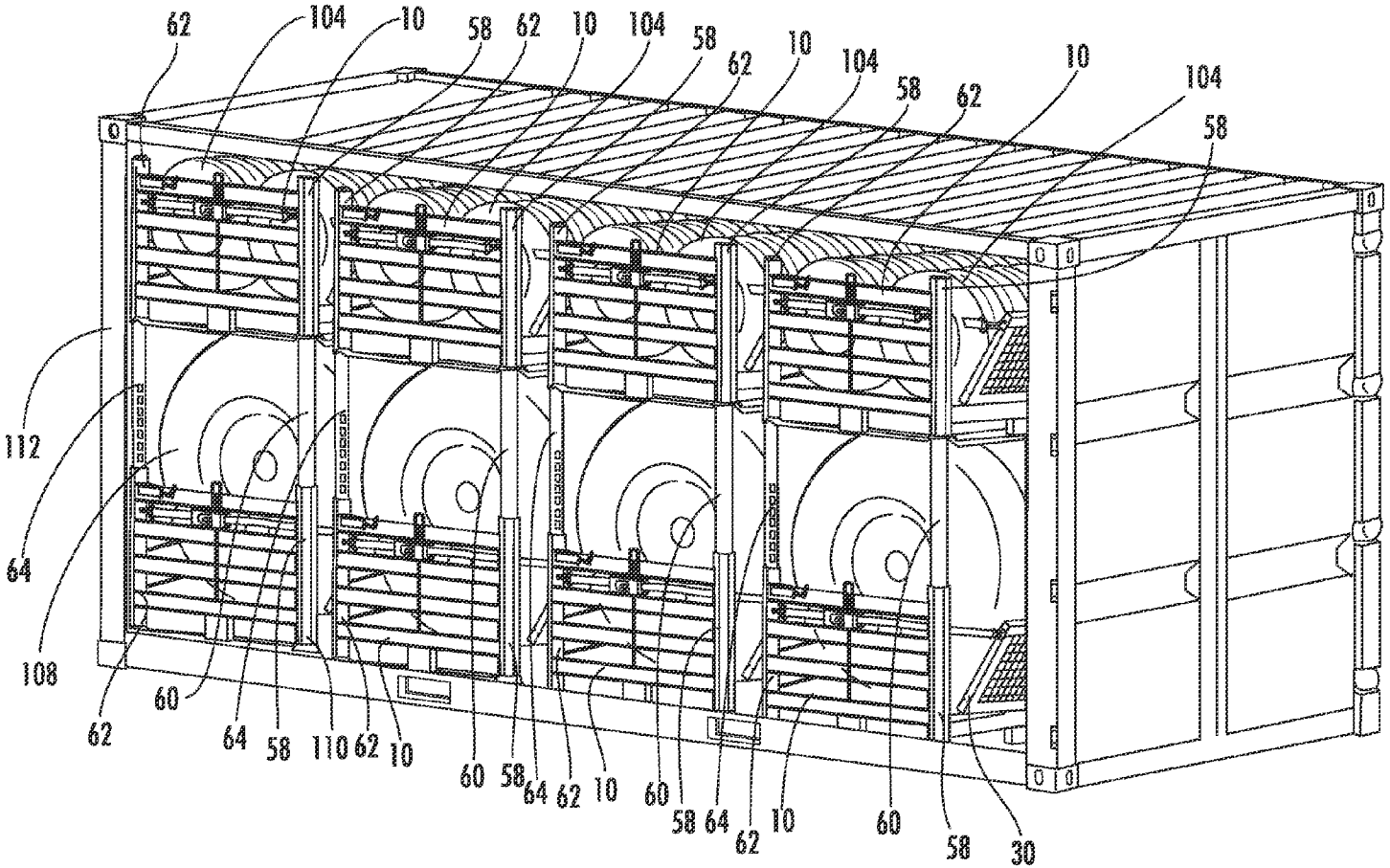
FIG. 12 is a perspective view of eight wheel storage and transport frames in a shipping container.

FIG. 12 shows how eight (8) frames may be arranged in a shipping container 112. In this arrangement, the bottom frames 10 have their extendible corner beams 60, 64, 68, 72 extended to accommodate large wheels 108. The large wheels 108 are so large that they extend past the first and fourth corner pillars 58, 70, and hence the panel 30 extends past the first and fourth corner pillars 58, 70 too, but is held in place abutting the wheels 108 via the straps 38, 42 and tensioning means 46. The top frames 10 are holding two rows of small wheels 104. The top frames 10 do not have their extendible corner beams 60, 64, 68, 72 installed.

Figure 13:
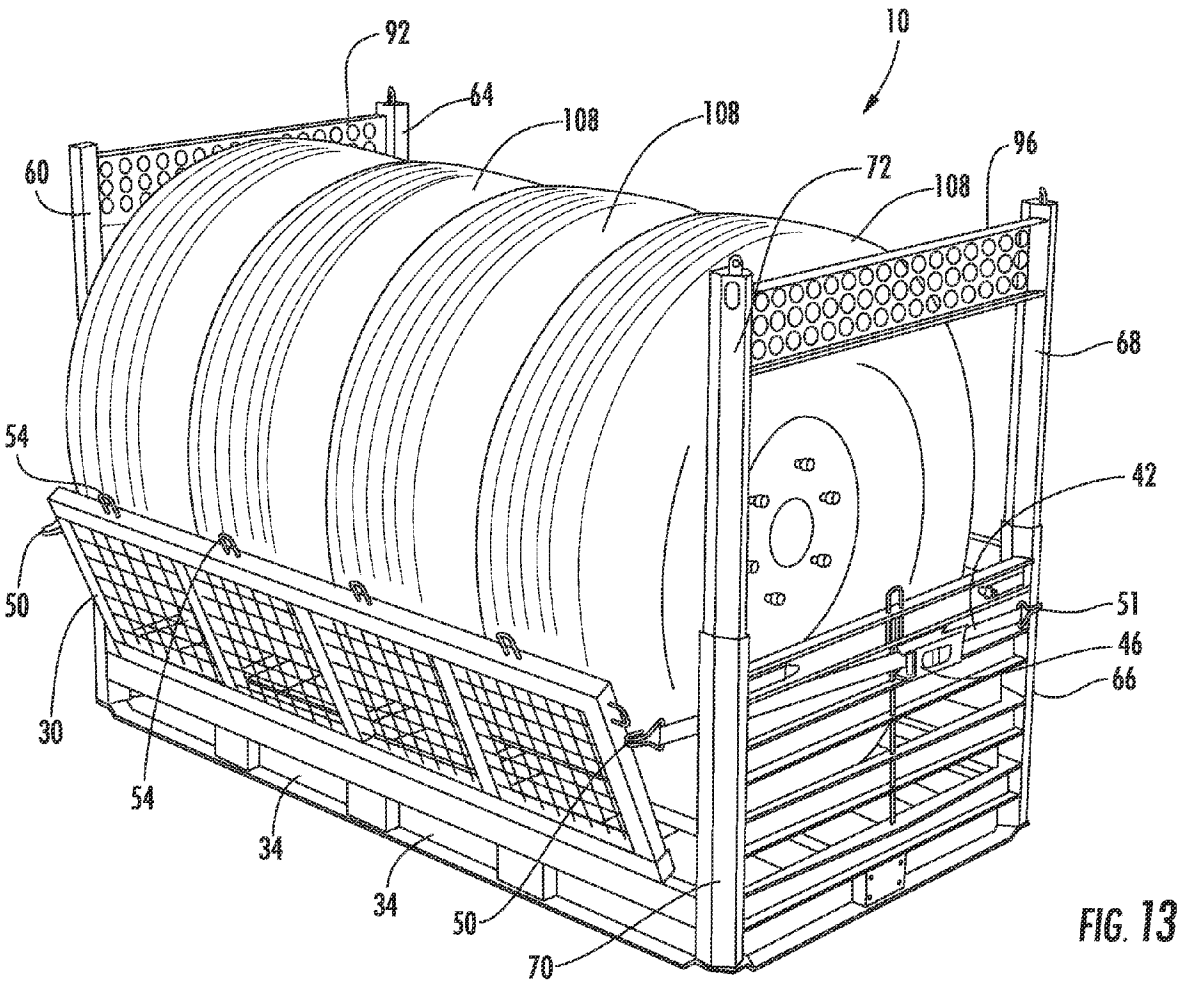
FIG. 13 is a perspective view of the wheel and transport frame with side walls installed, with wheels loaded.

FIG. 13 shows the frame with the first and second side walls 92, 96. The frame 10 is holding 4 large wheels 108. The first side wall is attached to the first extendible corner beam 60 and the second extendible corner beam 64. The second side wall 96 attaches to the third extendible corner beam 68 and the fourth extendible corner beam 72. The panel 30 is abutting the wheels 108, and is held in place by the straps 38, 42 and tensioning device 46.

In one embodiment the frame may have a minimum height of about 30 inches, and may have a maximum height (with the corner beams fully extended) of about 60 inches. The frame may have a length of about 91 inches and a width (depth) of about 45 inches. Of course the frame 10 may be sized to be larger or smaller.

The tire storage and transport frame may be made from high strength steel. The steel may be laser cut, formed, and welded together from flat sheets; there is no need to use preformed steel used (I.E. square tube, etc.) with the exception of a mesh which may be applied at the end of frame construction. The tire storage and transport frame may be dip galvanized to protect it from corrosion which is often encountered when shipping by sea.

The disclosed wheel storage and transport frame has many advantages. (1) It is durable—for multiple uses in varying environments with heavy loads; (2) it is flexible—to accommodate different types of material stored and transported in them; (3) it is compatible—with the different shipping assets used by our customers, ISO Containers, TRICON Containers, QUADCON Containers, 463L Pallets, Container Roll-On Platforms, and vehicles; (4) it maximizes available space by volume and reduce the logistics footprint; and (5) it is simple to use.

The disclosed wheel storage and transport frame can handle a variety of different sized wheels, including but not limited to wheels with a 52 inch diameter and 19 inch width down to wheels with a 24 inch diameter and 2.38 inch width.

The disclosed wheel storage and transport frame has adjustable height end walls that allow for the diameter on large and small wheels to be accounted for. The adjustable height end walls and hinged front panel allow for the flexibility of loading different size wheels.

The adjustable end-walls may be secured through the use of a heavy duty steel bar that is slid into position when the end-wall is at the desired height and secured by a padlock, snap-link, or cotter pin. In one embodiment, the locking steel bars are part of the base frame and cannot be removed. They simply slide into and out of position on a fixed rail.

The rotatable front panel may be secured through the use of a cargo strap.

The disclosed wheel storage and transport frame may have a maximum cargo weight capacity of 4000 lbs with a stacking weight of 12,000 lbs meaning that the bottom of the disclosed wheel storage and transport frame can hold three fully loaded disclosed wheel storage and transport frames stacked on top of it for a total of 12,000 lbs stacked. The purpose of having a 4000 lb capacity is to accommodate stacking the disclosed wheel storage and transport frames on top of each other also for the contingency of a new wheel or piece of equipment that may weigh more than the wheels we used as our guide during design.

The disclosed wheel storage and transport frame may be moved by pallet jack or forklift. There are forklift pockets on all four sides to accommodate moving the disclosed wheel storage and transport frame in and out of containers as well as from one location to another. The forklift pockets also accommodate stacking them on top of each other.

The dimensions of one embodiment of the disclosed wheel storage and transport frame were designed to fit into ISO shipping containers. Using the door dimensions for the container, the external dimensions of the disclosed wheel storage and transport frame were maximized such that loading and unloading ISO shipping containers would not be difficult. The width of the disclosed wheel storage and transport frame may be about 84 inches allowing for approximately about 2 to about 3 inches of clearance on each side to accommodate loading. During testing it was discovered that less than about 2 to about 3 inches of clearance on each side could be troublesome in the loading process if conditions were not perfect.

In one embodiment, the height dimension for the disclosed wheel storage and transport frame is between about 29 inches and about 59 inches depending on where the adjustable end wall is positioned for the particular wheels that are loaded in it. Depending on the wheel size the disclosed wheel storage and transport frame could load into a container individually or stacked to maximize space. The door opening on the standard shipping container is between 89 and 90 inches and the internal height dimension is 93 inches.

In one embodiment, the depth of the disclosed wheel storage and transport frame is about 45 inches. This depth accommodates for the range in different wheel dimensions and allows for loading five (depending on wheel size) into a standard 20 foot ISO container maximizing the space for the length of the container. Height depends on wheel types and dimensions.

The wheels may be stored in the vertical position when using the disclosed wheel storage and transport frame in accordance with (IAW) TM 38-400/NAVSUP PUB 572/AFMAN 23-2'10/MCO 4450.14/DLAM 4145.12. Additional anchor points are positioned along the front and back of the disclosed wheel storage and transport frame so the securing strap may be moved when wheels are removed. This will maintain the remaining wheels in a vertical position and not allow them to fall over. Anchor points across the front and back of disclosed wheel storage and transport frame are used to secure wheels when the frame is not completely loaded.

Beyond the anchor points placed on the disclosed wheel storage and transport frame, for the specific purpose of anchoring the strap in different positions, the design aspects of the disclosed wheel storage and transport frame allows for multiple alternative points to anchor straps to that all have the strength to accommodate the size and weight of the load such as vertical poles and corner posts.

The restraining system used for the disclosed wheel storage and transport frame may be two cargo straps. The design elements that caused us to use the cargo strap as opposed to other restraining systems were maintainability, sustainability, and simplicity. The specific model of cargo strap is in the Federal Supply System and can be ordered at anytime if the user should happen to break or lose one of the straps provided with the Frame. The use of a cargo strap allows for tightening to the dimension of the wheel loaded in the disclosed wheel storage and transport frame where a chain or other mechanism may allow for slack allowing movement while transporting the frame.

The disclosed wheel storage and transport frame is designed to stack four high when fully loaded. This means the disclosed wheel storage and transport frame will hold the weight. Balance and safety need to be considered if stacking or moving on uneven terrain or in poor weather conditions.

The disclosed wheel storage and transport frame may be made of high strength steel to make it durable enough for multiple uses and handling during loading and unloading with forklifts. All steel may be hot rolled HSLA that is laser cut IAW technical drawings, then bent using break press machines, and welded together. In one embodiment, there is no pre-fabricated steel used in the construction of the disclosed wheel storage and transport frame other than the wire mesh on the hinged front panel.

This invention has many advantages over the prior art. One advantage is that wheels can be stored in a vertical orientation in the tire storage and transport frame. Another is that the tire storage and transport frame can accommodate varying sizes of wheels to be transported, including wheels that may weigh up to 1000 pounds each, or more. Another advantage is that the tire storage and transport frame can be moved by forklift. A still other advantage is that the tire storage and transport frame can be stacked upon one another.

It should be noted that the terms “first”, “second”, and “third”, and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A wheel storage and transport frame comprising:

a floor;

a plurality of forklift pockets located on the front, rear and sides of the floor, a first corner pillar fixedly attached to the floor;

a second corner pillar fixedly attached to the floor;

a third corner pillar fixedly attached to the floor;

a fourth corner pillar fixedly attached to the floor, wherein the floor generally extends from the first, second, third and fourth corner pillars and provides a surface configured to support the weight of cargo stored and/or transported in the wheel storage and transport frame;

a first end wall fixedly attached to the floor and the first and second corner pillars;

a rear wall fixedly attached the floor and the second and third corner pillars;

a second end wall fixedly attached to the floor and third and fourth corner pillars;

a rotatable front panel rotatably attached to the floor via at least one hinged element, and adjacent to the first and fourth corner pillars, the bottom of the rotatable front panel remaining generally parallel to the floor, and the top of the rotatable front panel also remaining generally parallel to the floor and also moveable in generally a circular path;

a first rear attachment means removeably attachable to the wheel storage and transport frame;

a first strap attached to the first rear attachment means;

a first front attachment means attached to the first strap, and removeably attachable to the rotatable front panel;

a first tensioning means in communication with the first strap, and attached to the wheel storage and transport frame, where the first tensioning means is a tensioning buckle;

a second rear attachment means removeably attachable to the wheel storage and transport frame;

a second strap attached to the second rear attachment means;

a second front attachment means attached to the second strap, and removeably attachable to the rotatable front panel; and a second tensioning means in communication with the second strap, and attached to the wheel storage and transport frame, where the second tensioning means is a tensioning buckle; and wherein the rotatable front panel is configurable to be held in place by the first front attachment means, first strap, first tensioning means, and the second front attachment means, second strap, and second tensioning means such that the top of the rotatable front panel is generally inside the perimeter defined by the first, second, third and fourth corner pillars, and the rotatable front panel forms a generally an acute angle with the floor.

2. The wheel storage and transport frame of claim 1, further comprising:

a plurality of attachment means attached to the tops of the rear wall and the rotating front panel; and at least one attachment means attached to the tops of the first and second end walls.

3. The wheel storage and transport frame of claim 1, further comprising:

a first extendible corner beam, in slideable and fixable communication with the first corner pillar;

a second extendible corner beam, in slideable and fixable communication with the second corner pillar;

a third extendible corner beam, in slideable and fixable communication with the third corner pillar;

a fourth extendible corner beam, in slideable and fixable communication with the fourth corner pillar;

a first stabilizing means removably attachable to the first and second extendible corner beams; and a second stabilizing means removably attachable to the third and fourth extendible corner beams.

4. The wheel storage and transport frame of claim 3, wherein the first stabilizing means is a stabilizer bar attachable to the tops of the first and second extendible corner beams; and the second stabilizing means is a stabilizer bar attachable to the tops of the third and fourth extendible corner beams.

5. The wheel storage and transport frame of claim 3, wherein the first stabilizing means is a first side wall; and the second stabilizing means is a second side wall.

6. The wheel storage and transport frame of claim 3, further comprising:

a first stacking stabilizing member fixedly attached to the top of the first extendible corner beam;

a second stacking stabilizing member fixedly attached to the top of the second extendible corner beam;

a third stacking stabilizing member fixedly attached to the top of the third extendible corner beam;

a fourth stacking stabilizing member fixedly attached to the top of the fourth extendible corner beam;

a first orifice located generally in the bottom of the first corner pillar and configured to engage with the first stacking stabilizing member;

a second orifice located generally in the bottom of the second corner pillar and configured to engage with the second stacking stabilizing member;

a third orifice located generally in the bottom of the third corner pillar and configured to engage with the third stacking stabilizing member; and a fourth orifice located generally in the bottom of the fourth corner pillar and configured to engage with the fourth stacking stabilizing member.

7. The wheel storage and transport frame of claim 1, further comprising:

a plurality of intersecting horizontal and vertical members comprising the floor;

a plurality of intersecting horizontal and vertical members comprising the first end wall;

a plurality of intersecting horizontal and vertical members comprising the rear wall;

a plurality of intersecting horizontal and vertical members comprising the second end wall; and a plurality of intersecting horizontal and vertical members comprising the rotatable front panel.

8. The wheel storage and transport frame of claim 1, wherein when the rotatable front panel forms a generally an acute angle with the floor, the front panel abuts the cargo, thereby holding the cargo in place and maintaining the load integrity of the cargo in the wheel storage and transport frame.

* * * * *